US008177074B2

(12) United States Patent
Meltzer

(10) Patent No.: US 8,177,074 B2
(45) Date of Patent: May 15, 2012

(54) HOUSING FOR A DRYING DEVICE

(75) Inventor: Reinout Ignatius Maximiliaan Maria Meltzer, Rotterdam (NL)

(73) Assignee: Brabantia Nederland B.V., Waalre (NL)

( * ) Notice: Subject to any disclaimer, the term of this patent is extended or adjusted under 35 U.S.C. 154(b) by 928 days.

(21) Appl. No.: 12/117,754

(22) Filed: May 9, 2008

(65) Prior Publication Data

US 2008/0277358 A1 Nov. 13, 2008

(30) Foreign Application Priority Data

May 11, 2007 (NL) ..... 2000643

(51) Int. Cl.
*A47B 53/00* (2006.01)

(52) U.S. Cl. ..... 211/1.3; 211/96; 211/195; 24/3.12; 248/353

(58) Field of Classification Search ..... 211/189, 211/1.3, 165, 172, 96–102, 195; 206/575, 206/577, 9, 282, 283; 248/353; 312/310, 312/311, 324, 326; 190/106
See application file for complete search history.

(56) References Cited

U.S. PATENT DOCUMENTS

| | | | | | |
|---|---|---|---|---|---|
| 72,057 | A | * | 12/1867 | Lyman | 211/1.3 |
| 93,999 | A | * | 8/1869 | Johnson | 211/104 |
| 837,176 | A | * | 11/1906 | Beasley | 312/213 |
| 846,121 | A | * | 3/1907 | Matthews | 312/136 |
| 975,575 | A | * | 11/1910 | Scroggie | 211/95 |
| 1,156,286 | A | * | 10/1915 | Harbin | 211/165 |
| 1,269,012 | A | * | 6/1918 | Singleterry | 211/98 |
| 1,569,238 | A | * | 1/1926 | Reynolds | 211/165 |
| 1,581,840 | A | * | 4/1926 | De Garmo | 312/300 |
| 1,724,218 | A | * | 8/1929 | Nixon | 211/1.3 |
| 1,740,653 | A | * | 12/1929 | Hunneman, Jr. | 211/104 |
| 1,756,883 | A | * | 4/1930 | Russell | 211/74 |
| 1,836,008 | A | * | 12/1931 | Anzalone | 211/94.03 |
| 2,061,499 | A | * | 11/1936 | Bode | 211/1.3 |
| 2,434,891 | A | * | 1/1948 | Swanson | 211/97 |
| 2,483,606 | A | * | 10/1949 | Albach et al. | 312/257.1 |
| D157,362 | S | * | 2/1950 | Francis | D6/441 |
| 2,642,331 | A | * | 6/1953 | Sprinkle | 312/283 |
| 2,814,542 | A | * | 11/1957 | Gleitsman | 312/201 |
| 4,203,171 | A | * | 5/1980 | Bolt | 4/608 |
| 4,239,310 | A | * | 12/1980 | Benjamin | 312/227 |
| 4,265,051 | A | * | 5/1981 | Williams | 49/7 |
| 4,304,027 | A | * | 12/1981 | Di Fazio | 16/249 |

(Continued)

FOREIGN PATENT DOCUMENTS

AU 26373/67 A 2/1970

(Continued)

*Primary Examiner* — Darnell Jayne
*Assistant Examiner* — Devin Barnett
(74) *Attorney, Agent, or Firm* — Young & Thompson

(57) ABSTRACT

A housing for a drying device which can be folded in and folded out comprises a base which is situated on the rear side and can be attached to a vertical support, such as a wall, and with respect to which the drying device can be folded in to form an elongate unit, wing means which are suspended on the base and can be pivoted along a pivot axis directed in the longitudinal direction of the unit between a closed position for covering the folded drying device and an open position in which the drying device can be folded in and out, as well as supporting means for supporting the drying device with respect to the housing. The wing means, in the closed position, extend forwards with respect to the base.

17 Claims, 6 Drawing Sheets

U.S. PATENT DOCUMENTS

| | | | | | |
|---|---|---|---|---|---|
| D264,658 | S | * | 6/1982 | de Polo et al. | D6/436 |
| 4,434,897 | A | * | 3/1984 | Gelhaus | 211/1.3 |
| 4,632,255 | A | * | 12/1986 | Kennedy | 211/1.3 |
| 5,280,841 | A | * | 1/1994 | Van Deursen | 211/197 |
| 6,003,964 | A | * | 12/1999 | Baker | 312/206 |
| D420,015 | S | * | 2/2000 | DeBoer | D15/89 |
| 6,033,046 | A | * | 3/2000 | Lambright | 312/321.5 |
| D472,070 | S | * | 3/2003 | de Carolis | D6/441 |
| D499,925 | S | * | 12/2004 | Kwok | D6/632 |
| D505,031 | S | * | 5/2005 | Chen | D6/441 |
| D510,206 | S | * | 10/2005 | Jennings et al. | D6/441 |
| D615,770 | S | * | 5/2010 | Meltzer | D6/441 |
| 2005/0248244 | A1 | * | 11/2005 | Burigana et al. | 312/310 |
| 2008/0031585 | A1 | * | 2/2008 | Solheid et al. | 385/135 |
| 2009/0084744 | A1 | * | 4/2009 | Meltzer | 211/105 |

FOREIGN PATENT DOCUMENTS

| | | | |
|---|---|---|---|
| FR | 2 198 374 | A | 3/1974 |
| GB | 2 072 501 | A | 10/1981 |
| NL | 1 026 543 | C2 | 1/2006 |

* cited by examiner

HOUSING FOR A DRYING DEVICE

BACKGROUND OF THE INVENTION

The invention relates to a housing for a drying device which can be folded in and folded out, comprising a base which is situated on the rear side and can be attached to a vertical support, such as a wall, and with respect to which the drying device can be folded in to form an elongate unit, wing means which are suspended on the base and can be pivoted along a pivot axis directed in the longitudinal direction of the unit between a closed position for covering the folded drying device and an open position in which the drying device can be folded in and out, as well as supporting means for supporting the drying device with respect to the housing.

Such a housing is known from U.S. Pat. No. 4,434,897. This known housing comprises a cabinet which can be hung, for example, on a wall. The front of the cabinet, which comprises a rear wall, side walls and upper walls, is formed by a flat door which can be opened and closed. From the upper wall of the cabinet, a first drying device is suspended which comprises a frame from which a number of bars can be radially extended after the door is opened and the frame is folded back. The lower wall of the cabinet likewise has such a drying device comprising a frame and bars which can be folded out when the door is open.

Although this known housing is suitable for the above-described drying devices, in which the frame is folded out first, followed by the bars, said housing is less suitable for other drying devices. Reference is made to the drying device disclosed by the Dutch patent 1,026,543 comprising a frame with an arm assembly and a cooperating rod assembly. When such a drying device is folded out, its dimensions in both transverse directions increase, as a result of which the initial folding out inside the cabinet is difficult. The increasing transverse dimensions of the drying device may result in the arms colliding with the side walls, and, conversely, folding in may also lead to problems.

It is therefore an object of the invention to provide a housing for a drying device which can be used more generally, and in which folding in and folding out of a drying device when the housing is open does not result in problems. Said object is achieved by means of the wing means which, in the closed position, extend forwards with respect to the base.

SUMMARY OF THE INVENTION

With the housing according to the invention, the wing means can be folded away completely, so that they come to lie at a relatively large distance from the folded-in drying device, and virtually against the vertical support. As a result, the drying device can be folded out without problems, even if, during the folding out, the dimensions of the drying device not only increase towards the front with respect to the base, but also if the dimensions increase at the sides. In addition, such an embodiment of the housing offers the possibility of adapting the shape thereof to the type of drying device which can be accommodated in the housing, as only the wing means have to be changed.

Such wing means can be designed in various ways; thus it is conceivable, for example, to employ only a single wing or door. Such a wing or door may, for example, be articulated. However, preference is given to an embodiment in which the wing means comprise two wings which are each suspended on an opposite edge of the base. In that case each wing, in its closed position, may form an entire transverse side and a part of the front side. Furthermore, the wings may adjoin one another in a sealing manner at their edge turned away from the suspension means.

In order to completely seal the housing, which is important if the housing is used in combination with the drying device outside, each of the wings may comprise a cover on the top side. In that connection, each of the wings may also comprise a cover on the bottom side.

The practical embodiment of the wings can be effected in various ways. It is important that the wings are sufficiently strong to keep the housing in the closed position, even when the latter is exposed to rain, wind and the like. On the other hand, it is not desirable to make the wings heavy so as not to render operation difficult. Therefore, an embodiment is preferred in which each of the wings comprises a sheet material and, on the side which is turned towards the pivot pin, a torsion bar, which torsion bar is suspended so as to be pivotable.

The sheet material of the wings can be relatively thin, and may, for example, comprise plastic or metal. However, the torsional stiffness of the relatively long wings is ensured by the fact that a torsion bar is also provided which also acts as a pivoting suspension. In this case, a top and a bottom pivot piece may be attached to each torsion bar, in which case corresponding supporting pieces are attached to the base, in such a manner that each pair comprising a pivot piece and a supporting piece forms a pivoting suspension.

The pivot piece and the supporting piece of each pair have supporting surfaces which are turned towards one another and which may be chamfered in such a manner that the wings try to swing into the open position on account of gravity. When opening the housing, this offers the advantage that the drying device is readily accessible, without the wings still being in the way. In order to prevent damage to the external surface of the wings when they are swung open, end stops may be provided in order to determine the swung-open end position of the wings.

In practice, the base is already supplied with the corresponding drying device, so that it can be hung on an external wall. In order to complete the housing, the wings and associated pivoting suspensions can then be provided retrospectively. This can be achieved in an effective manner if the top supporting pieces form part of a top support which can be attached to the top end of the base. Analogously thereto, the bottom supporting pieces may form part of a bottom support which can be attached to the bottom end of the base. Such supporting pieces can be retrospectively pushed onto a base which is already attached to a wail, following which the wings can be suspended on said supporting pieces. In particular, the base may comprise a flat panel provided with means, such as suitable openings, for hanging it on a wall.

The dimensions of the base of the known drying device are such that the drying device can be folded in and can be kept in a stable position when folded out. The longitudinal dimensions of such a base are approximately equal to half the longitudinal dimensions of the wing(s), which base extends from the top side of the wing(s) up to approximately the centre thereof. Such a drying device is known from the Dutch patent 1,026,543 referred to above.

The invention also relates to, in combination, a housing as described above and a drying device which can be folded in and folded out and is suspended on the base. Said drying device may comprise a frame having at least three arms which are arranged in an evenly distributed manner around an arm joint, at least three bars which are analogously arranged in an evenly distributed manner around a bar joint, with in each case one bar being pivotably connected to an arm in such a manner that the joints move apart when the arms and bars are folded in and move towards one another when the arms and bars are folded out. At the end turned away from the arm joint, one of the arms is pivotably suspended on the base and the bar which is pivotably connected to said arm can be coupled to the base in the folded-out position.

BRIEF DESCRIPTION OF THE DRAWINGS

The invention will be described in more detail below with reference to an exemplary embodiment illustrated in the figures, in which.

DETAILED DESCRIPTION OF THE PREFERRED EMBODIMENTS

Figure 1:
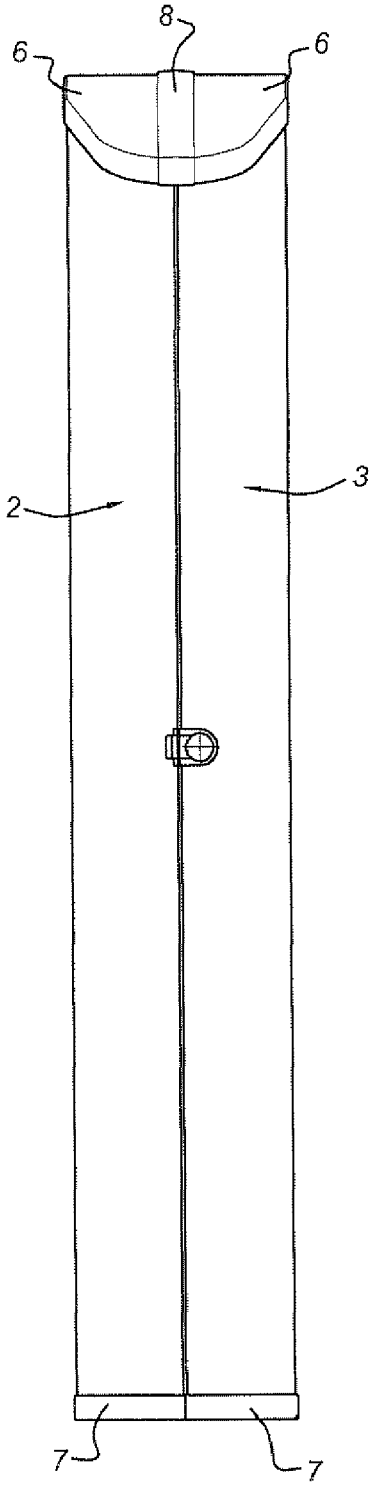
FIG. 1 shows a front view of the closed housing according to the invention.
Figure 2:
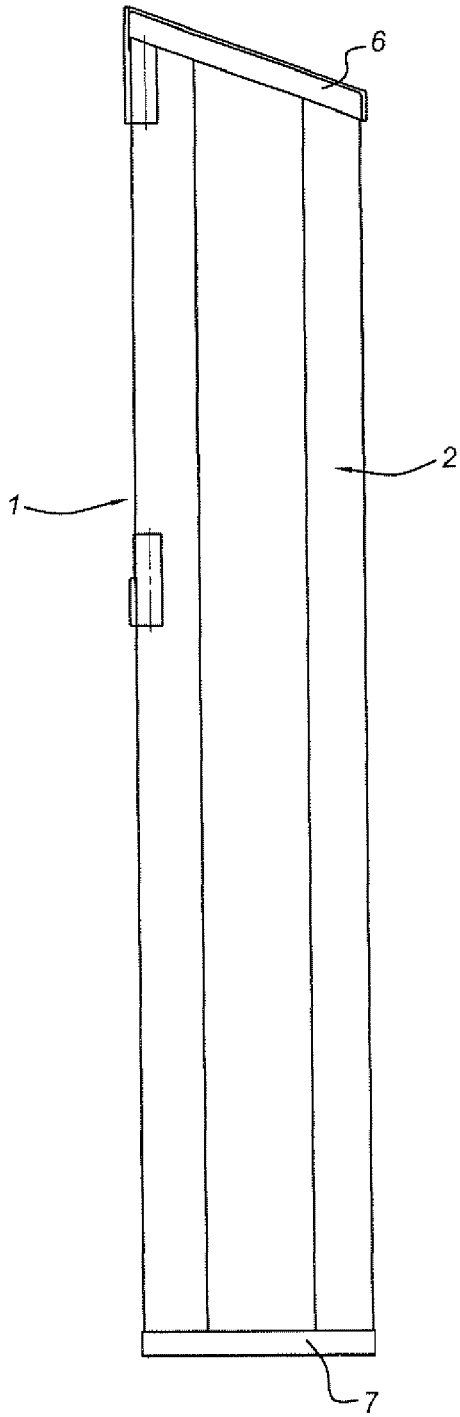
FIG. 2 shows a side view.
Figure 7:
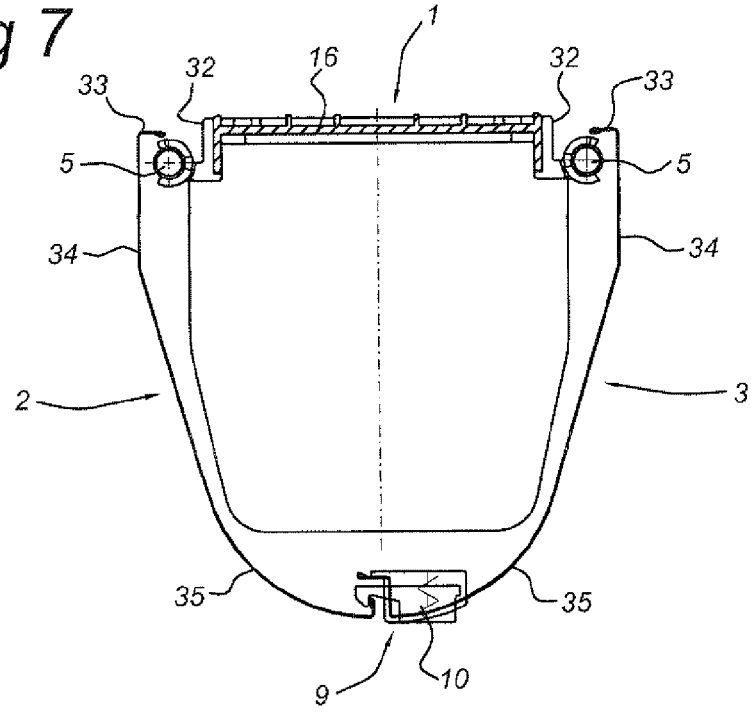
FIG. 7 shows a cross section through the closed housing.
Figure 8:
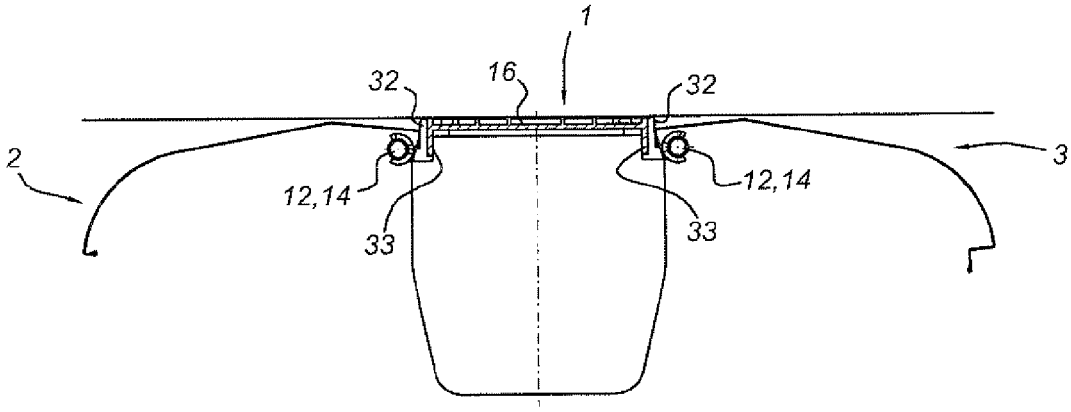
FIG. 8 shows a cross section through the open housing.

The housing illustrated in FIGS. 1 and 2 comprises a base 1 and two wings 2, 3 pivotably suspended on either side of the base 1. These wings 2, 3 each comprise a shaped panel 4 and a torsion bar 5 (see FIG. 3). The panel 4 may be relatively thin and weak, while the wings 2, 3 still have the required stiffness due to the torsion bar 5. The top side of the wings 2, 3 has a cover 6, the bottom side likewise has a cover 7. The top covers 6 overlap one another in an overlapping region 8, while the wings 2, 3 also form an overlapping region 9 in the closed position as illustrated in FIG. 7. As a result, said covers 6,7 also render the wings 2, 3 more rigid. FIG. 7 also shows the closure 10 by means of which the wings 2, 3 can be held in the closed position. As can further be seen in FIGS. 7 and 8, the wings 2, 3, in the closed position, extend forwards with respect to the base 1. In the closed position, the wings 2, 3 each form a transverse side 34 as well as a part 35 of the front side of the housing. The advantage of such a configuration is that the wings 2, 3 in the open position, as illustrated in FIG. 8, almost completely clear the base 1 in such a manner that the drying device (not shown in FIGS. 7 and 8) can fold out to the front and to the side, without being hampered by the housing.

The open position of the housing is determined by the stops 32, which the edges 33 of the wings 2, 3 hit when the former is in the completely open position.

A top pivot piece 11 and a bottom pivot piece 12 are attached to each of the torsion bars 5. In addition, top supporting pieces 13 and bottom supporting pieces 14 are provided on the base 1, which form part of a top support 15 and a bottom support 16, respectively. Said supports 15, 16 are attached to the top side and the bottom side, respectively, of the base 1. The pivot pieces 11, 12 and the supporting pieces 13, 14 have pairs of supporting surfaces 17 which are chamfered in such a manner that the wings try to swing into the open position on account of gravity. As soon as the closure 10 is opened, the wings will swing to the open position which facilitates the ease of use.

Figure 3:
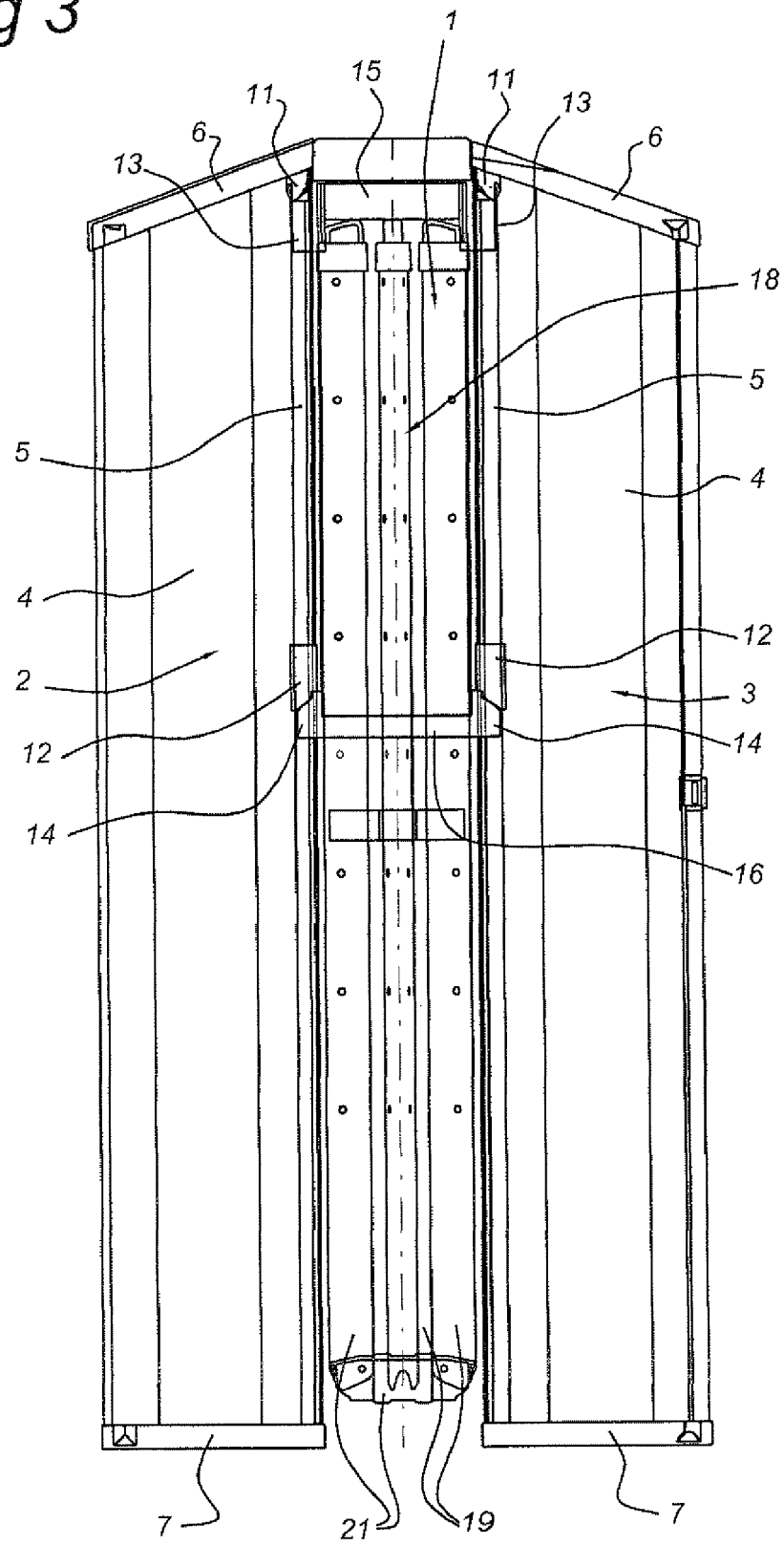
FIG. 3 shows a front view of the open housing with the drying device folded up.
Figure 4:
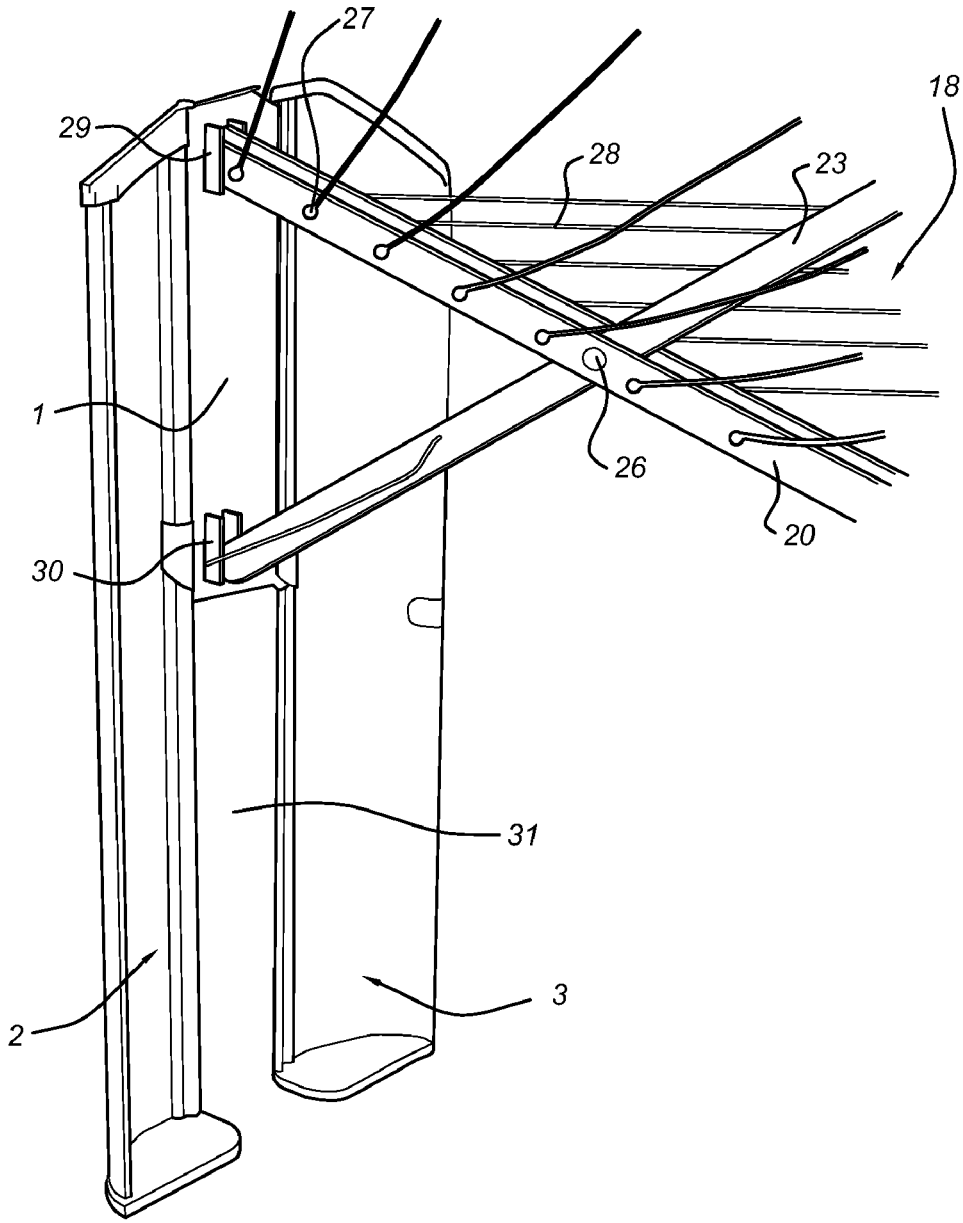
FIG. 4 shows a perspective view of the open housing with the drying device folded out.
Figure 5:
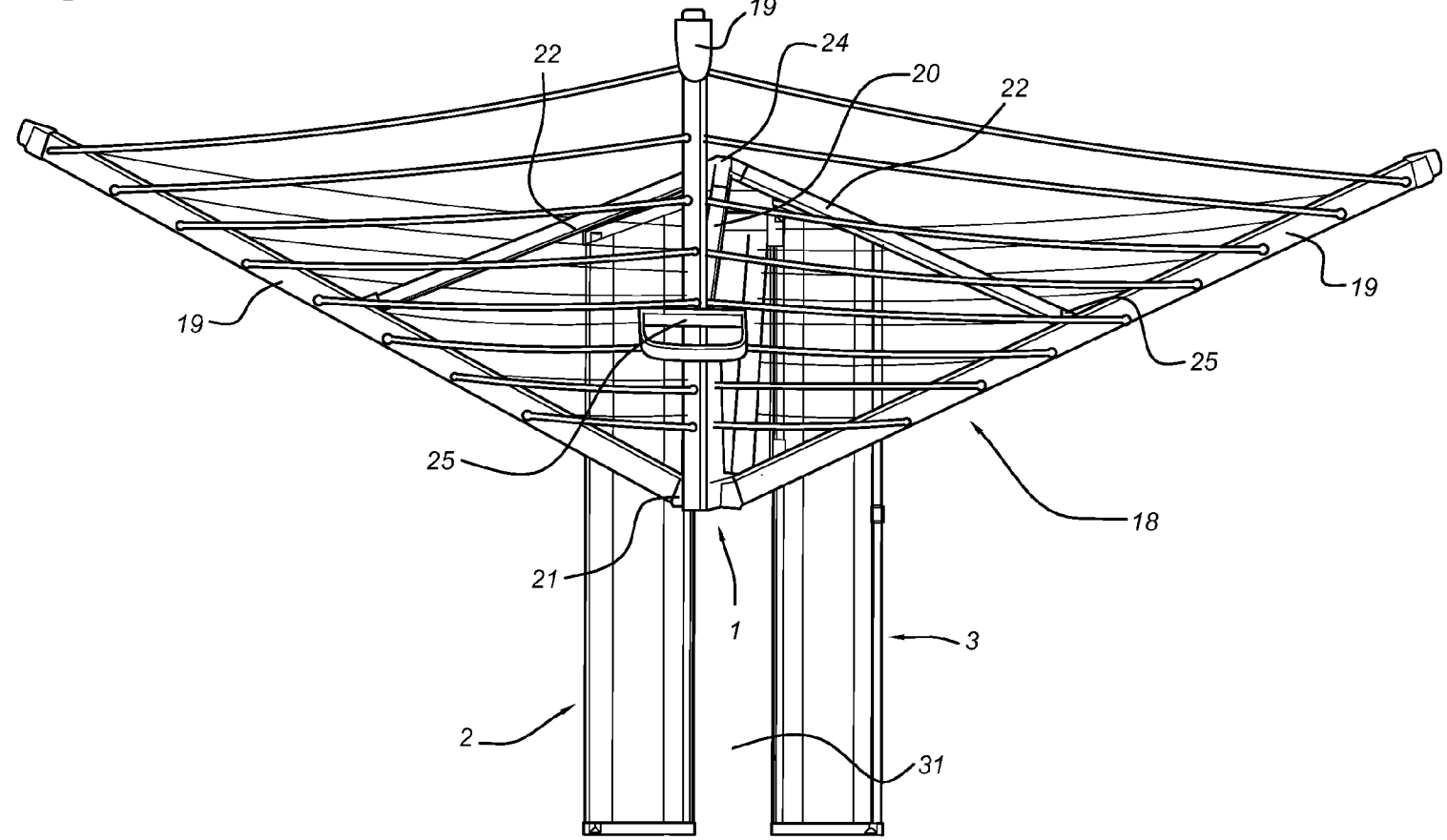
FIG. 5 shows a further perspective view.
Figure 6:
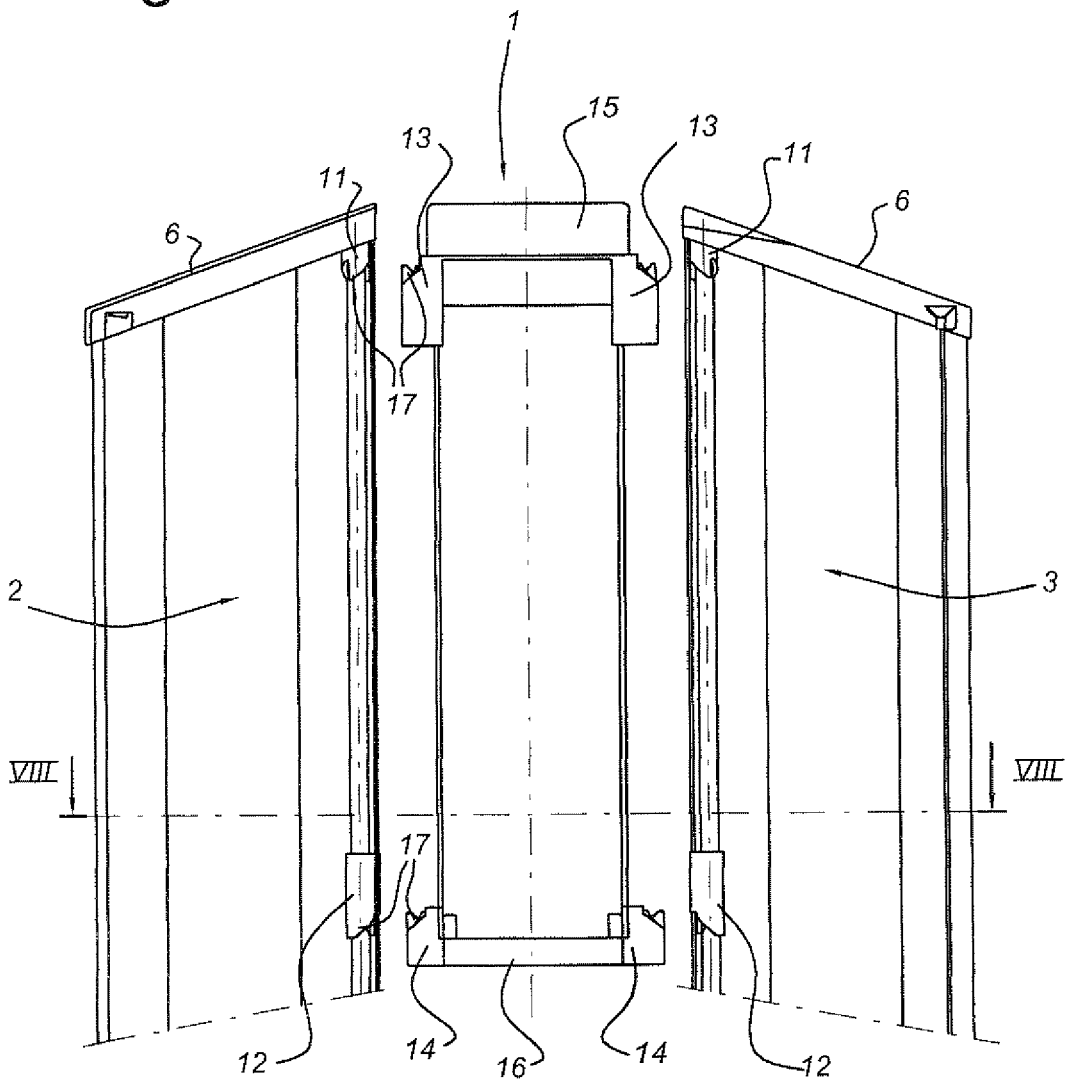
FIG. 6 shows a front view of the housing with detached wings.

As illustrated in FIG. 3, the drying device which is denoted overall by reference numeral 18 is suspended on the base 1. Said drying device 18 has three arms and a double arm 19, 20. The arms 19, 20 are hingedly connected to an arm joint 21. The drying device furthermore comprises four bars 22, 23 which can be seen in FIGS. 4 and 5. These bars 22, 23 are hingedly connected to a bar joint 24 (see FIG. 5); in addition, the ends of the bars 22 are connected to the arms 19, 20, namely approximately halfway along the length of the latter, by means of hinges 25. The bar 23 is longer than the bars 22 (see FIG. 4), in such a manner that said bar 23 and the associated arm 20 are both connected by a hinge 26 halfway along their length. To this end, the arm 20 is designed in two parts comprising parallel arm sections 27, 28, so that the arm 23 is hingedly accommodated between said arm sections 27, 28.

The arm 23, in particular the arm sections 27, 28 thereof, are suspended by means of a hinge 29 near the top side of the base 1; the bar 23 is detachably connected to the suspension means 31 at the bottom of the base 1. The base 1 itself may be attached to any vertical support, such as the wall 31 shown in FIGS. 4 and 5. In this case, the wail is preferably an outer wall, although this is not obligatory: the base 1 may, for example, also be attached to an inner wall, or to a rack or the like.

The invention claimed is:

1. A drying device and housing for same, comprising:

a rear base (1) extending from a top end to a bottom end and adapted to be attached to a vertical support;

a drying frame suspended on the rear base and configured to be folded in to the base to form an elongated unit, the drying frame having i) at least three arms (19, 20) arranged in an evenly distributed manner around an arm joint (21), and ii) at least three bars (22, 23) which are analogously arranged in an evenly distributed manner around a bar joint (24), the bars (22, 23) being pivotably connected to the arms (19, 20) in such a manner that the joints move apart when the arms and the bars are folded in, and move towards one another when the arms and the bars are folded out, and at an end (29) turned away from the arm joint (21), one (20) of the arms is pivotably suspended on the base (1), and one of the bars (23) which is pivotably connected to one of the arms (20) is couplable to the base (1) in at least a folded-out position;

wing means (2, 3) suspended on the base (1) the wing means (2, 3) adapted to be pivoted, about a pivot axis in a longitudinal direction of the unit, between a closed position for covering the folded drying device (18) and an open position in which the drying device is capable of being folded in and out, the wing means (2, 3) comprising two wings (2, 3) each suspended on an opposite edge of the base (1), said wings (2, 3), in the closed position, extending forwards with respect to the base (1); and supporting means (29, 30) for supporting the drying device (18) with respect to the base, wherein, in the closed position, edges of the wings (2, 3) adjoin each other in a sealing manner (9) at a position spaced forward from the base, and each wing (2, 3) forms an entire transverse side (34) and a part of a front side (35) of the housing.

2. The drying device and housing according to claim 1, in which each of the wings comprises a torsion bar (5), each of the torsion bars (5) located on a side of a corresponding wing turned towards the pivot axis, and each of the torsion bars (5) being suspended so as to be pivotable.

3. The drying device and housing according to claim 1, in which the wings in the closed position form an overlapping region.

4. The drying device and according to claim 2, in which each of the torsion bars (5) are configured to stiffen the corresponding wing.

5. The drying device and housing according to claim 1, in which each of the wings (2, 3) comprises a top cover (6) on a top side of the wing, the top covers of the wings adapted to adjoin one another in a sealing manner when the wings are in the closed position.

6. The drying device and housing according to claim 1, in which each of the wings (2, 3) comprises a bottom cover (7) on a bottom side of the wing.

7. The drying device and housing according to claim 1, in which each of the wings (2, 3) comprises a sheet material (4).

8. The drying device and housing according to claim 2, in which a top (11) and a bottom (12) pivot piece are attached to each torsion bar (5), and supporting pieces (13, 14) corresponding to the top and bottom pivot pieces are attached to the base in such a manner that each pair comprising a pivot piece and a supporting piece forms a pivoting suspension.

9. The drying device and housing according to claim 8, in which the pivot piece (11, 12) and the supporting piece (13, 14) of each pair have supporting surfaces (17) which are turned towards one another.

10. The drying device and housing according to claim 9, in which the supporting surfaces (17) of each pair are chamfered in such a manner that the wings (2, 3) are urged to swing into the open position due to the force of gravity.

11. The drying device and housing according to claim 8, in which the top supporting pieces (13) form part of a top support (15) which is attached to the top end of the base (1).

12. The drying device and housing according to claim 8, in which the bottom supporting pieces (14) form part of a bottom support (16) which is attached to the base (1).

13. The drying device and housing according to claim 1, in which locking means (10) are provided for locking the wings (2, 3) into a locked position with respect to one another.

14. The drying device and housing according to claim 1, in which end stops (32, 33) are provided in order to determine the swung-open end position of the wings (2, 3).

15. The drying device and housing according to claim 1, in which the base (1) further comprises a flat panel provided with means for hanging the base (1) on a vertical support (31).

16. The drying device and housing according to claim 1, in which the longitudinal dimensions of the base (1) are approximately equal to half the longitudinal dimensions of the wings (2, 3), said base extending longitudinally from a top side of the wings to approximately a center of a longitudinal length of the wings.

17. The drying device and housing according to claim 5, in which the top covers, in the closed position, overlap one another in an overlapping region.

* * * * *